US005568669A

United States Patent [19]

Godown

[11] Patent Number: 5,568,669

[45] Date of Patent: Oct. 29, 1996

[54] LOTION APPLICATOR

[76] Inventor: Terrye T. Godown, 200 Strawberry Ridge La., Irmo, S.C. 29063-9017

[21] Appl. No.: 451,138

[22] Filed: May 26, 1995

[51] Int. Cl.[6] ..... A45D 40/26

[52] U.S. Cl. ..... 15/143.1; 15/144.4; 15/145; 15/244.1; 601/154; 132/320

[58] Field of Search ..... 15/1, 104.001, 15/143.1, 104.94, 145, 144.4, 244.1, 245.1, 236.02; 132/218, 317, 318, 320; 16/115; 601/137, 138, 154

[56] References Cited

U.S. PATENT DOCUMENTS

| | | | |
|---|---|---|---|
| 652,096 | 6/1900 | Dunn | 16/115 |
| 1,406,841 | 2/1922 | Foss | 15/144.4 |
| 2,054,849 | 9/1936 | Briggs | 15/145 |
| 2,294,631 | 9/1942 | Rocca | 15/145 |
| 2,641,012 | 6/1953 | Storrs | 15/144.4 |
| 2,740,150 | 4/1956 | Wilding | 601/138 |
| 3,407,424 | 10/1968 | Lanzarone | 15/144.4 |
| 3,539,185 | 11/1970 | Andis | 16/115 |
| 4,329,755 | 5/1982 | Alissandratos | 15/144.4 |
| 4,769,869 | 9/1988 | Benitez | 15/143.1 |
| 5,117,815 | 6/1992 | Gentry | 601/138 |
| 5,176,754 | 1/1993 | Hirzel | 132/320 |
| 5,263,222 | 11/1993 | Johnstone, II | 15/236.02 |
| 5,388,700 | 2/1995 | Per-Lee | 132/320 |

FOREIGN PATENT DOCUMENTS

| | | | |
|---|---|---|---|
| 1044277 | 11/1953 | France | 601/137 |
| 3043094 | 7/1982 | Germany | 132/320 |
| 0430291 | 6/1935 | United Kingdom | 601/137 |
| 735255 | 8/1955 | United Kingdom | 15/144.4 |

*Primary Examiner*—David Scherbel
*Assistant Examiner*—Randall E. Chin
*Attorney, Agent, or Firm*—Michael A. Mann, P.A.

[57] ABSTRACT

An applicator for use in applying lotion comprises a housing, a handle and an applicator pad. The housing is hollow so as to receive the handle therein when the handle is being stored. The applicator pad is attached to the housing and is used to spread lotion, such as suntan lotion, on one's back. The end of the handle has a locking ring, endplug or endcap that is designed to hold by friction the handle to the housing, either in the stored position with the handle in the housing, or in the extended position for use. The applicator pad has an annular depression to enable the pad to control the spread of the lotion. Lotion is spread toward the depression by the higher center and thus over the pad,but the excess lotion is confined to it by the higher edge of the pad. The present applicator will enable more efficient application of lotion by applying all of it rather than absorbing part of it.

12 Claims, 3 Drawing Sheets

LOTION APPLICATOR

BACKGROUND OF THE INVENTION

1. Field of the Invention:

The present invention relates to devices for applying lotions. In particular, the present invention is an device for applying suntan lotion to one's back.

2. Discussion of Background:

It is virtually impossible for someone to apply suntan lotion to one's own back without assistance. Failure to apply suntan lotion can, of course, result in sunburning. Therefore, if someone is going to be in the sun for extended periods of time, one either needs assistance or must have some way to apply the suntan lotion.

Applicators for use in applying suntan lotion are known. However, they are not satisfactory for several reasons. First, many have sponge-like pads that absorb as much suntan lotion as they apply. In addition to being inefficient deliverers of lotion to the back, these sponge-like pads cannot easily be cleaned after use, and replacement pads are not often available at reasonable prices or at local stores for the convenience of the consumer. Furthermore, some individuals use more than one type of lotion, with each type having different sun protection factors. The sponge-like pads would tend to blend different lotions so that the user would be unsure of exactly which type is being applied and lotions with higher sun protection factors would be diluted by lotions with low factors. Finally, because they cannot be cleaned, use of these types of applicators by more than one person is not advisable.

There is another type of applicator where a charge of lotion in the head is ejected through holes to a body-engaging surface. These applicators quickly become clogged with dried lotion and are even more difficult to clean.

Another problem associated with current applicators is that they are long, not sufficiently rigid or easy to use and do not easily fit into carry bags.

In addition to applying suntan lotion to one's back, there are other types of lotions, moisturizers and creams that someone may want to apply to one's back. Furthermore, some individuals have difficulty reaching parts of their bodies and may need an applicator to do so.

There is, therefore, a need for an applicator suitable for applying lotion to one's back and other hard-to-reach parts of the body and that is efficient in its delivery of lotion and can be easily cleaned after use.

SUMMARY OF THE INVENTION

According to its major aspects and briefly stated, the present invention is an applicator for use in applying lotion to one's back. The applicator comprises a housing, a handle dimensioned to be received inside said housing for storage, and an applicator pad. The handle can be removed from the housing, reversed and then fitted to it to form a compound handle for greater reach in use. The applicator pad is formed to distribute lotion in a controlled manner, as will be described in detail herein.

The type of material and the shape of the applicator pad are important features of the present invention. The material is smooth and non-porous so that it does not absorb lotion and can be easily wiped or washed clean for repeated use. The resilient material is contoured so that it conforms easily to the shape of the user's body and is made of a material that can be tinted or colored for aesthetic appeal. The surface is formed with an annular depression to urge the lotion over its surface when pressed against the user's back, but it also tends to confine excess lotion not immediately absorbed into the skin, spreading it out thoroughly to cover the skin more efficiently, rather than smear it. This characteristic is important because one cannot see where the lotion is being applied. Therefore, it is important that there be good correspondence between where the applicator pad touches the back and where the lotion is applied. Without this correspondence, parts of the back might be inadequately covered by lotion.

Another important feature of the present invention is the means for securing the handle to the housing, which can be made of the same material as the applicator pad for efficiency in manufacturing. The end of the handle that secures it to the open end of the housing in storage of the handle in the housing also secures the handle to the housing when they form the compound handle. This dual function end simplifies construction and reduces cost. It also makes the present applicator easy to use.

Still another feature of the present invention is the texturing of the handle's exterior surface for better gripping. This textured surface is important when hands may be slippery with lotion or wet. Other features and advantages will be apparent to those skilled in the art from a careful reading of the Detailed Description of Preferred Embodiments accompanied by the following drawings.

Figures 1, 2, 3, 4, 8:
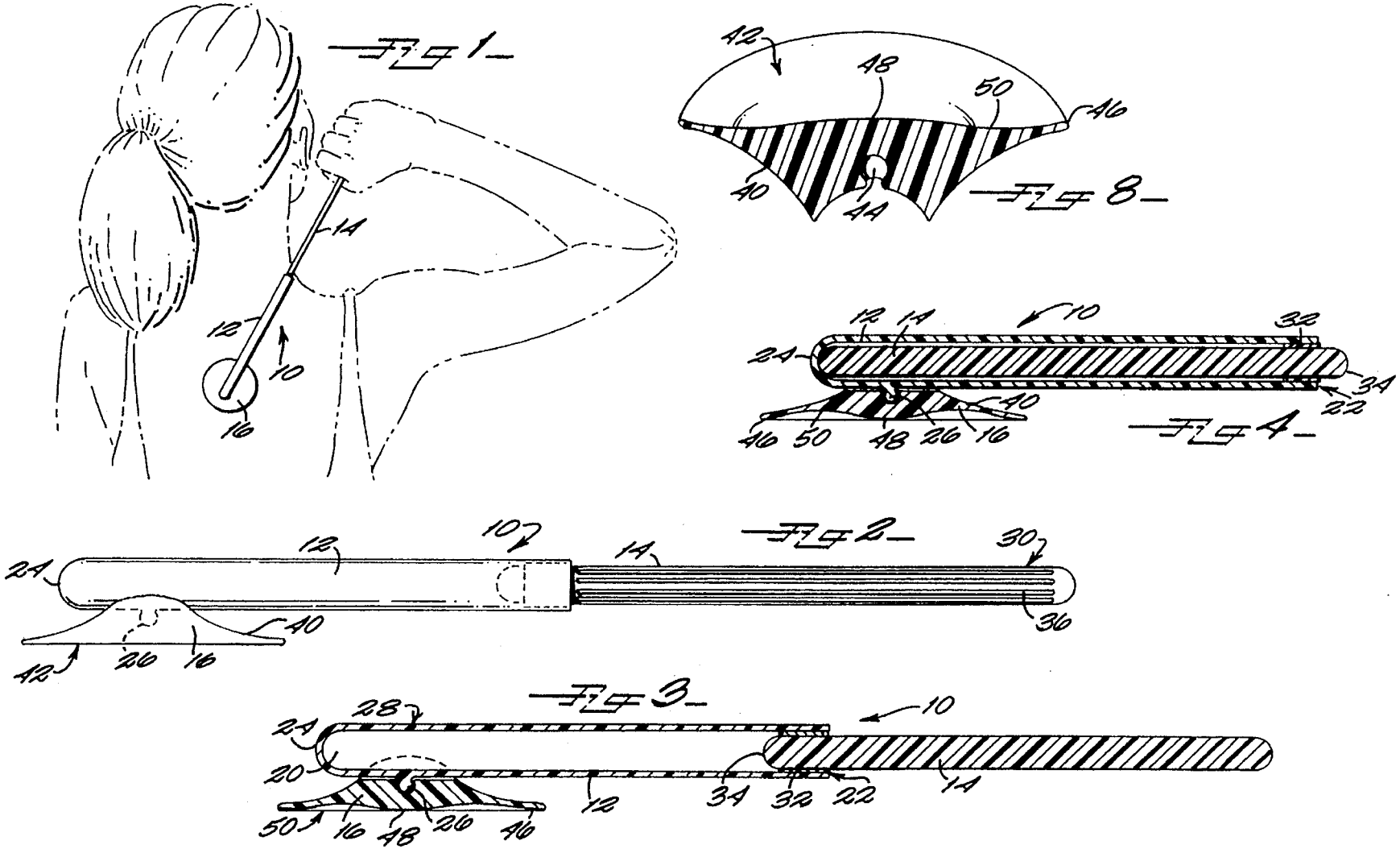
FIG. 1 is a perspective view of an applicator in the extended position according to a preferred embodiment of present invention.
FIG. 2 is a side view of the applicator of FIG. 1 in the extended position.
FIG. 3 is a side cross sectional view of the applicator of FIG. 1 in the extended position.
FIG. 4 is a side cross sectional view of the applicator of FIG. 1 in the storage position.
Figure 9:
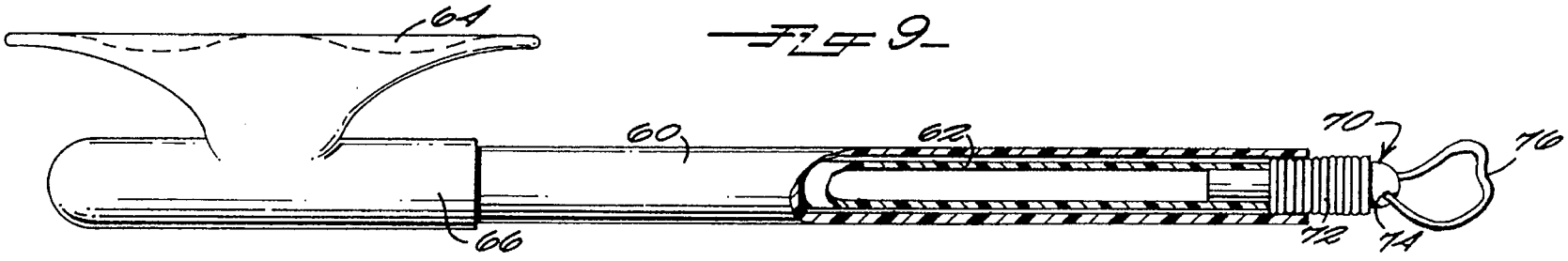
Figure 10:
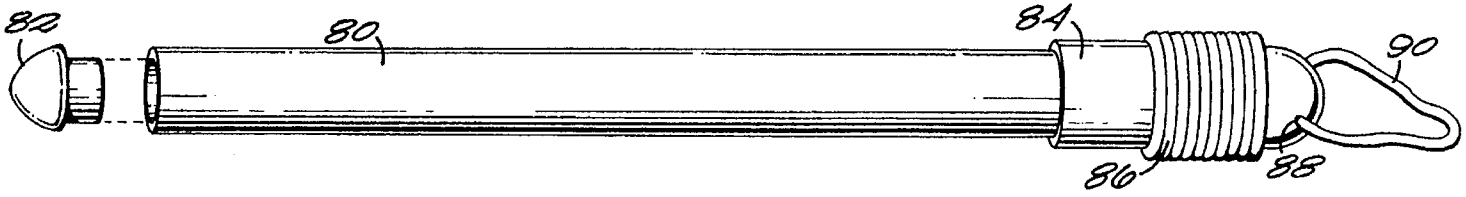

FIGS. *7a–7d* illustrate four embodiments of the locking ring according to preferred embodiments of the present invention;

FIG. 8 is a partially cut away perspective view of the applicator pad according to a preferred embodiment of the present invention;

FIG. 9 is a side view, partially cut away to show a cross sectional view of part of the handle and housing, illustrating an alternative embodiment of an applicator according to a preferred embodiment of the present invention; and FIG. 10 is a side view of the handle of the present applicator showing an alternative end fitting according to a preferred embodiment of the present invention.

DETAILED DESCRIPTION OF PREFERRED EMBODIMENTS

The present invention is an applicator for use in applying lotion to one's back. Although specifically intended for suntan lotion, the present applicator can apply any type of lotion or oil. Furthermore, although most individuals can apply lotion everywhere on their bodies except their back without assistance, some individuals cannot, and the present applicator may help them reach hard-to-reach places.

Referring now to the figures, the present applicator, generally referred to using the reference numeral 10, will be seen to have three major components: a housing 12, a handle 14 and an applicator pad 16. Further, especially in comparing FIGS. 3 to 4, it will be seen that applicator 10 has two configurations: an extended configuration where handle 14 is substantially exterior to housing 12, and a stored configuration where handle 14 is substantially received inside of housing 12, but in both configurations, housing 12 is secured to handle 14. Applicator pad 16 can be used in either configuration; however, it is easier to use applicator pad 16 when applicator 10 is in the extended configuration, as shown in FIG. 1.

Housing 12 has an interior 20 and an open end 22 and a closed end 24. Housing 12 has a projection 26 on its exterior surface 28 to secure applicator pad 16. Handle 14 is preferably dimensioned to store tubes of lipbalm, if the user so desires.

Figure 5:
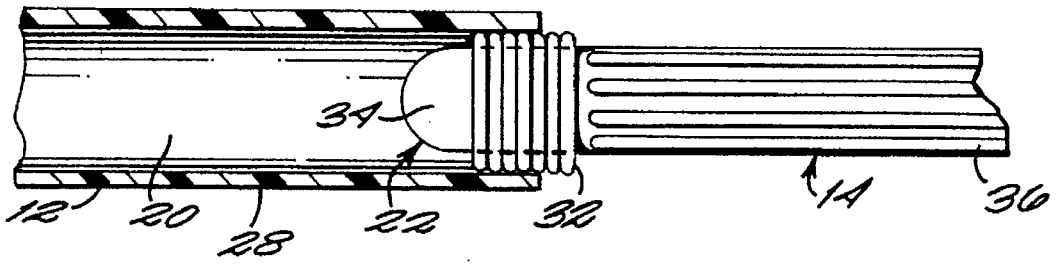
FIG. 5 is a detailed cross sectional view of the end of the handle locked to the end of the housing when the applicator of FIG. 1 is in the extended position.
Figure 6:
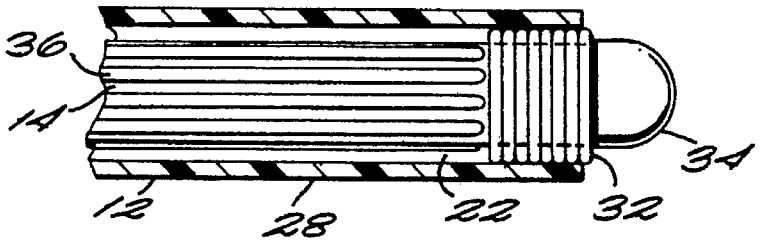
FIG. 6 is a detailed cross sectional view of the end of the handle locked to the end of the housing when the applicator of FIG. 1 is in the storage position.
Figure 7A:
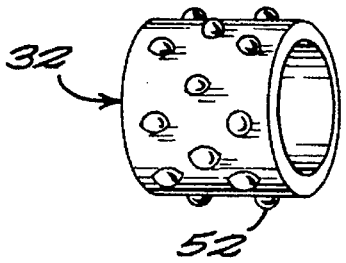
Figure 7B:
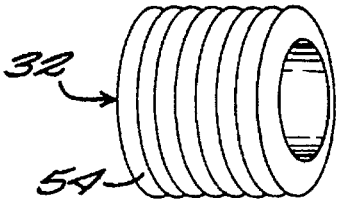
Figure 7C:
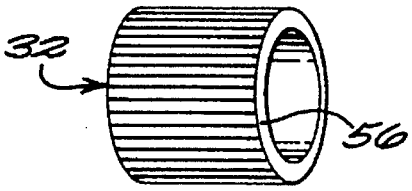
Figure 7D:
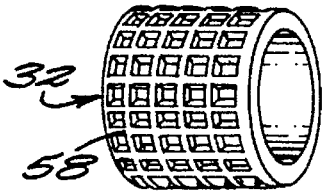

Handle 14 has a textured exterior surface 30 and a locking ring 32 on one end 34. Textured exterior surface 30 may have longitudinal ridges 36, as shown, or some other type of surface treatment including radial ridges, helical ridges, hatching, cross hatching, or even a coating or sleeve that provides a good frictional surface for gripping handle 14 when one's hands are wet or covered with lotion. Locking ring 32 is preferably a rubber or rubber-like cylinder, or can be made of the same material as pad 16, having surface variations as illustrated in FIGS. *7a–7d*, which include bumps 52, radial ridges 54, longitudinal grooves 56, and cross hatched ribs 58, respectively. Locking ring 32 may be glued to end 34 or slipped into an annular recess around end 34, or both, to secure it to handle 14. Its purpose is to secure end 34 of handle 14 to open end 22 of housing 12 in the extended configuration (best seen in FIG. 5) and in the stored configuration (best seen in FIG. 6).

Applicator pad 16 has a first side 40 and a second side 42. As seen in FIG. 8, first side 40 is configured to conform to exterior surface 28 of housing 12 and to receive projection 26 in a recess 44. Second side 42 is generally flat and circular and is the surface on which lotion is applied by the user. It tapers to a thin edge 46 from a thicker center 48. Although generally flat, second side 42 has a topographical feature that is important in applying lotion. It has an annular depression 50 (see also FIGS. 3 and 4). Depression 50 defines and separates a higher area at center 48 from a higher area at edge 46.

If lotion is applied to second side 42, the higher area at center 48, pressed against the user's back, will cause the lotion to spread out over second side 42 from center 48 to annular depression 50. Edge 46, being higher than depression 50 will tend to spread lotion back to depression 50, thereby tending to confine lotion to second side 42. Therefore, applicator pad 16 operates to spread lotion over second side 42 but to confine the excess of lotion not being absorbed onto the skin within the peripheral edge 46 of second side 42.

As suggested above, because one cannot see one's own back, one is forced to assume a correspondence between the location of an applicator pad and the area of the body to which lotion is being applied. Everywhere the applicator is moved, one assumes, the lotion is applied, and applied evenly. If an applicator does not control the application of the lotion by confining it to some extent—carrying the excess with it and leaving only a thin coating of lotion—the lotion will simply be smeared around unevenly or, in places, not at all.

FIGS. 9 and 10 illustrate alternative preferred embodiments of the present invention. Specifically, FIG. 9 shows a housing 60 with a handle 62 in the stored configuration and an applicator pad 64 secured to housing with an integral end cap 66 rather than conforming to its exterior surface and receiving a projection as shown in FIGS. 3 and 4 above. End cap 66 could be glued or frictionally fitted to housing 60. Handle 62 is hollow and has an end plug 70 inserted in one end. End plug 70 has fibs 72 for use in securing handle 62 to housing 60. End plug 70 is thus functionally equivalent to locking ring 32 of FIGS. 5 and 6. End plug 70 has a hole 74 for receiving a lanyard 76 for the convenience of the user.

FIG. 10 illustrates a hollow handle 80 with an end plug 82 on one end and an overcap 84 on the other end. Overcap 84 has ridges 86 to secure handle 80 to its housing such as that shown in FIG. 9 and identified by reference number 60. Overcap 84 also has a hole 88 for a lanyard 90.

The housing and handle are preferably made of a durable plastic, and most preferably made of an ultraviolet (UV) stabilized plastic that can take on a color or tint and that can be easily injection molded or extruded, such as acrylic. The applicator pad is preferably made of a material that can also be tinted or colored, is not porous and smooth, and has a low durometer value so it is highly resilient, such as vinyl. Being non-porous and smooth, the applicator pad will not absorb lotion but will apply it to the user's back. It is also easier to clean.

In use, handle 14 is removed from housing 12 of applicator 10 simply by pulling it free of open end 22. It is then reversed to place end 34 of handle 14 into open end 22 of housing 12 where the two are frictionally held together to form, in the extended configuration, a compound handle. Lotion is applied to second side 42 of applicator pad 16 (or directly to the user's back) and applicator 10 used to reach one's back.

Applicator pad 16 will not absorb lotion or oil, but lotion or oil residue, if any, can then be wiped clean with a tissue or cloth, or the entire applicator can be washed, and handle 14 can be removed from housing 12 simply by pulling them apart. Then handle 14 is again reversed and inserted into housing 12 so that end 34 and open end 22 are, in the stored configuration, frictionally engaged.

It will be clear to those skilled in the art from the foregoing description that many changes and substitutions can be made to the preferred embodiments without departing from the spirit and scope of the invention, which is defined by the appended claims.

What is claimed is:

1. An applicator for use in applying lotion, said applicator comprising:

a housing having an interior and an open end;

a handle receivable in said interior of said housing, said handle having a first end and an opposing second end;

means earned by said first end of said handle for securing said first end of said handle to said open end of said housing so that said handle can be secured to said housing either when said second end of said handle is in said interior of said housing or when said second end of said handle is exterior to said housing; and an applicator pad carried by said housing said applicator pad having a surface on which said lotion is applied, said surface having an annular depression formed therein.

2. The applicator as recited in claim 1, wherein said applicator pad is made of a resilient material.

3. The applicator as recited in claim 1, wherein said applicator pad has a surface on which said lotion is applied by a user, said surface formed to urge said lotion to spread over said surface when pressed against said user's back.

4. The applicator as recited in claim 1, wherein said surface of said applicator has a thin edge.

5. The applicator as recited in claim 1, wherein said housing and said handle are made of ultraviolet stabilized plastic.

6. The applicator as recited in claim 1, wherein said securing means further comprises an endplug carried on said first end of said handle, said endcap frictionally engaging said interior of said housing.

7. The applicator as recited in claim 1, wherein said applicator pad includes an endplug, and said housing is inserted into said endcap of said applicator pad to secure said applicator pad to said housing.

8. The applicator pad as recited in claim 1, wherein said handle has an exterior surface, and said handle has means formed on said exterior surface for gripping said handle.

9. An applicator for use in applying lotion, said applicator comprising:

a housing having an interior, a closed end and an opposing open end;

a hollow handle receivable in said interior of said housing, said handle having an exterior surface, a first end and an opposing second end;

means carried by said first end of said handle for securing said first end of said handle to said open end of said housing so that said handle can be secured to said housing either when said second end of said handle is in said interior of said housing or when said second end of said handle is exterior to said housing; and an applicator pad carried by said housing, said applicator pad having a surface on which said lotion is applied, said surface having an annular depression formed therein.

10. The applicator as recited in claim 9, wherein said securing means is an endplug having means formed thereon for frictionally engaging said interior of said housing.

11. The applicator as recited in claim 9, wherein said applicator pad has an integral endcap and said closed end of said housing fits into said endcap.

12. The applicator pad as recited in claim 9, wherein said handle has an exterior surface, and said handle has means formed on said exterior surface for gripping said handle.

* * * * *